US006155067A

United States Patent [19]

Ono et al.

[11] Patent Number: 6,155,067

[45] Date of Patent: Dec. 5, 2000

[54] ENCLOSED COMPRESSOR AND COOLING SYSTEM

[75] Inventors: Takeshi Ono; Yoshito Kataoka, both of Chigasaki; Yasushi Hayashi; Hiroshi Sasano, both of Fujisawa, all of Japan

[73] Assignee: Matsushita Refrigeration Company, Osaka, Japan

[21] Appl. No.: 09/355,367

[22] PCT Filed: May 20, 1998

[86] PCT No.: PCT/JP98/02209

§ 371 Date: Oct. 12, 1999

§ 102(e) Date: Oct. 12, 1999

[87] PCT Pub. No.: WO98/53204

PCT Pub. Date: Nov. 26, 1998

[30] Foreign Application Priority Data

May 21, 1997 [JP] Japan ..... 9-130775

[51] Int. Cl.[7] ..... F25D 19/00

[52] U.S. Cl. ..... 62/296; 417/312; 181/403

[58] Field of Search ..... 62/296; 417/312; 181/229, 403

[56] References Cited

U.S. PATENT DOCUMENTS

| | | | |
|---|---|---|---|
| 5,205,719 | 4/1993 | Childs et al. | 181/403 |
| 5,304,044 | 4/1994 | Wada et al. | 417/312 |
| 5,341,654 | 8/1994 | Hewette et al. | 62/296 |
| 5,988,990 | 4/1999 | Lee | 417/312 |

*Primary Examiner*—William E. Tapolcai
*Attorney, Agent, or Firm*—Sheridan Ross, P.C.

[57] ABSTRACT

A hermetic compressor of the present invention is provided with one or more small holes 17 formed in the shell of the suction muffler 16 formed with a low thermal conductivity material such as synthetic resin. The small holes 17 are positioned at nodes 18 in a vibration mode for the resonance frequency of the space formed in the hermetic shell, so that amplification of the resonance sound of the space in the hermetic shell 1 is suppressed. Furthermore, a shortage of the refrigerant is supplemented by the refrigerant gas sucked from the hermetic shell 1 through the small holes 17 when it occurs due to a suction loss caused by the resistance of the flow path for guiding a high density refrigerant gas from the suction tube into the cylinder 8 according to the circulation of the refrigerant.

16 Claims, 6 Drawing Sheets

PRIOR ART

PRIOR ART

ENCLOSED COMPRESSOR AND COOLING SYSTEM

TECHNICAL FIELD

The present invention relates to a hermetic compressor for use with a refrigerator, etc. and a cooling system that uses the hermetic compressor, and more particularly, to a hermetic compressor structured so that a refrigerant is led into a cylinder directly from a suction tube through a suction muffler.

BACKGROUND ART

Hermetic compressors having a high energy conversion efficiency respectively are in great demand in recent years, and generally, it is known that a low thermal conductivity material such as synthetic resin, etc. is suitable for a suction muffler used for a direct suction system of such a hermetic compressor.

A known conventional hermetic compressor is disclosed in the Official Gazette of Japanese Examined Patent Publication Hei 3-258980.

FIG. 5 is a front view of a structure of the conventional hermetic compressor, wherein a hermetic shell 101 shown in FIG. 5 is cross-cut. FIG. 6 is a side cross sectional view of the hermetic compressor shown in FIG. 5.

In FIGS. 5 and 6, the hermetic shell 101 houses an electric driving device 102 and a compressing mechanism 103 in itself. The electric driving device 102 includes a stator 104, a rotor 105, and a crank shaft 106. The compressing mechanism 103 includes a cylinder head 107, a cylinder 108, a piston 109, and a connecting rod 110. The connecting rod 110 is linked to an eccentric part 111 of the crank shaft 106 of the electric driving device 102. As shown in FIG. 6, the electric driving device 102 and the compressing mechanism 103 are elastically supported by a spring 103*a* in the hermetic shell 101.

As shown in FIG. 5, a suction tube 112 is fixed to the hermetic shell 101 and disposed so as to upstand inside the hermetic shell 101. The suction muffler 116 is formed with a synthetic resin material and fixed to the cylinder head 107.

The suction tube 112 and the suction muffler 116 are connected to each other via a communicating portion 113. The communicating portion 113 has a coil spring 114 and a connecting tube 115. As shown in FIG. 5, the lower end of the coil spring 114 is press-fittingly fixed to one end of the suction tube 112, and the upper end of the coil spring 114 is press-fittingly fixed to one end of the connecting tube 115. The other end of the connecting tube 115 is inserted in the suction muffler 116.

In the conventional hermetic compressor configured as described above, when the electric driving device 102 is started up and the crank shaft 106 is rotated, the motion of the crank shaft 106 is transmitted to the piston 109 via the eccentric part 111 and the connecting rod 110, so that the piston 109 makes a reciprocating motion in the cylinder 108. With such the reciprocating motion of the piston 109, a refrigerant, passing through the coil spring 114 and the connecting tube 115, is fed from the suction tube 112 into the cylinder 108 via the suction muffler 116 so as to be sucked, compressed, and discharged therefrom.

The suction muffler 116 attenuates the rippling sound generated when in suction of the refrigerant, in the cylinder 108.

In the conventional hermetic compressor configured as described above, however, the resistance of the gas flow path in the suction route to which the suction tube 112 and the suction muffler 116 are connected via the coil spring 114 is increased, causing a suction loss when a high density gas is led into the cylinder 108 from the suction tube 112 according to the circulation of the refrigerant. Consequently, the conventional hermetic compressor has confronted with problems that the volumetric efficiency is lowered and accordingly the refrigerating capacity is lowered.

DISCLOSURE OF INVENTION

Under such the circumstances, it is an object of the present invention to solve the prior art problems by minimizing the suction loss caused by the resistance of the gas flow path in the suction route of the hermetic compressor to thereby improve the volumetric efficiency and the refrigerating capacity.

In order to achieve the above object, the hermetic compressor of the present invention comprises:

- an electric driving device supported with elastic holding means in a hermetic shell and having a stator and a rotor;
- a compressing mechanism driven by said electric driving device and used for compressing a refrigerant;
- a suction tube passing through said hermetic shell;
- a suction muffler formed with a low thermal conductivity material and fixed to said compressing mechanism;
- a communicating portion for communicating from said suction muffler to said suction tube; and
- a means for communicating from a space in said refrigerant suction path led to said compressing mechanism to a space in said hermetic shell.

According to the hermetic compressor of the present invention, composed as described above, therefore, it is possible to minimize the suction loss in the suction path while suppressing amplification of the resonance sound in the space in the hermetic shell.

In the hermetic compressor of the present invention, the means for communicating from the space in the refrigerant suction path led to the compressing mechanism to the space in the hermetic shell is one or more small holes, which are formed in the shell of the suction muffler to communicate the space in the hermetic shell to the space in the suction muffler.

Furthermore, in the hermetic compressor of the present invention, since one or more small holes formed in the shell of the suction muffler to communicate to the space in the hermetic shell are positioned at nodes in a vibration mode for the resonance frequency in the space in the hermetic shell, a shortage of the refrigerant is supplemented with the refrigerant gas sucked from the hermetic shell through the small holes, caused by a suction loss due to the resistance of the gas flow path in the suction route of a high density gas led into the cylinder from the suction tube in the circulation of the refrigerant. Consequently, the hermetic compressor of the present invention can minimize the suction loss and attenuate the rippling sound generated when in suction of the refrigerant using the suction muffler. The sound emitted from the small holes is thus attenuated and it is prevented that the sound emitted from the small holes amplifies the resonance sound in the space in the hermetic shell.

Furthermore, the hermetic compressor of the present invention uses a refrigerant composed of HC (hydrocarbon) or HFC (hydro-fluorocarbon) that includes no chlorine. Thus the present invention can prevent from destroying the ozonosphere.

The hermetic compressor of the present invention uses a mixed refrigerant of R-22 and R-152a that are low in ODP (ozone destroy parameter) respectively. Thus, the hermetic compressor of the present invention will not destroy the ozonosphere.

Since the hermetic compressor of the present invention is operated with a household supply frequency of 60 Hz using an inverter, the quantity of the gas sucked into the suction route led to the suction muffler is increased and accordingly the quantity of the circulating refrigerant is increased. In addition, if a shortage of the refrigerant occurs in the suction route along which a high density gas from the suction tube is led into the cylinder, the refrigerant gas is sucked, and the shortage of it caused by a suction loss due to the resistance of the gas flow path is supplemented from the hermetic shell through one or more small holes formed in the shell of the suction muffler. Consequently, the hermetic compressor of the present invention can minimize the suction loss and attenuates the rippling sound generated at suction of the refrigerant, using the suction muffler. The sound emitted from the small holes is thus attenuated. In addition, since the small holes are positioned at nodes in a vibration mode for the resonant frequency in the space in the hermetic shell, the sound emitted from the small holes can suppress amplification of the resonance sound in the space in the hermetic shell.

In the cooling system of the present invention comprising a compressor, a condenser, a drier, a capillary, and an evaporator, the compressor includes an electric driving device supported elastically in the hermetic shell and having a stator and a rotor;

a compressing mechanism driven by the electric driving device and used for compressing a refrigerant;

a suction tube passing through the hermetic shell;

a suction muffler formed with a low thermal conductivity material and fixed to said compressing mechanism;

a communicating portion for communicating from the suction muffler to the suction tube; and means for communicating from a space in the refrigerant suction path led to the compressing mechanism to a space in the hermetic shell so as to be positioned at nodes in a vibration mode for the resonance frequency in the space in the hermetic shell.

In the cooling system of the present invention, composed as described above, since a high density gas is sucked according to the circulation of the refrigerant, the volumetric efficiency is improved to thereby improve the cooling system efficiency and suppress an increase of noise.

While the novel features of the invention are set forth particularly in the appended claims, the present invention, both as to organization and content, will be better understood and appreciated, along with other objects and features thereof, from the following detailed description taken in conjunction with the drawings.

It will be recognized that some or all of the figures are schematic representations for purposes of illustration and do not necessarily depict the actual relative sizes or locations of the elements shown.

BEST MODE FOR CARRYING OUT THE INVENTION

Hereunder, the preferred embodiments of the hermetic compressor of the present invention will be described with reference to the accompanying drawings.

First Embodiment

Figure 1:
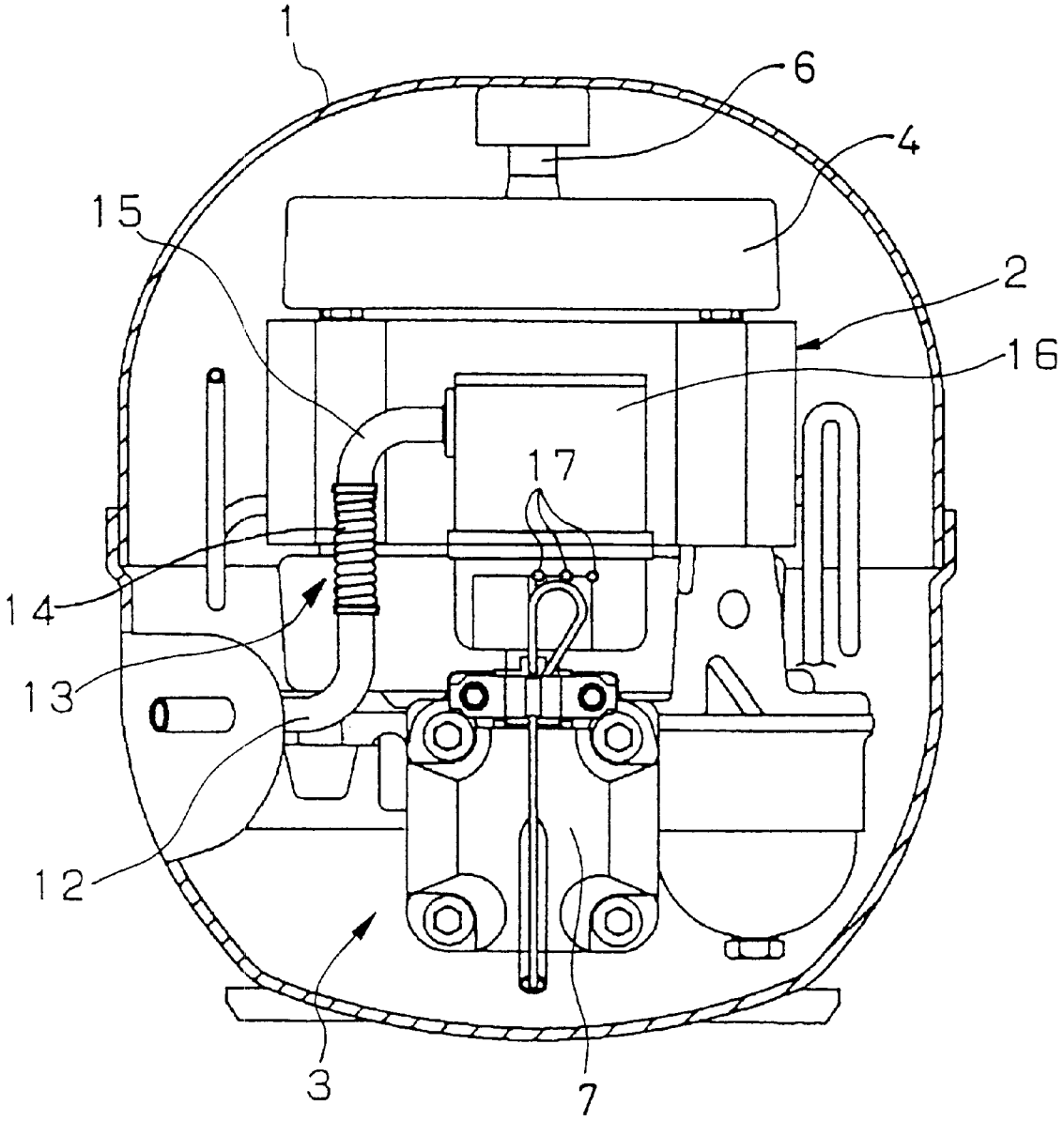
FIG. 1 is a front view of a hermetic compressor in the first embodiment of the present invention.
Figure 2:
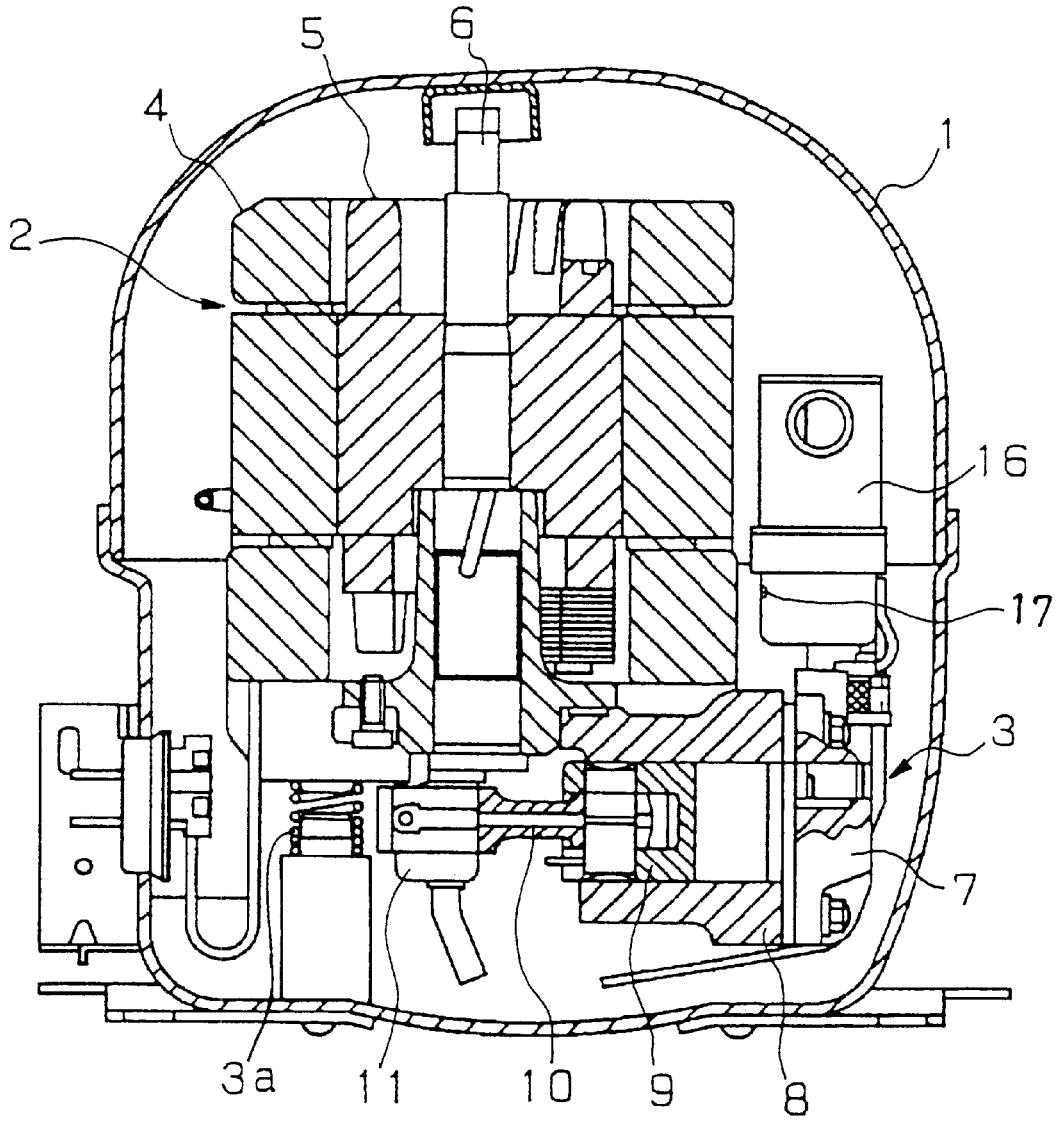
FIG. 2 is a side cross sectional view of the hermetic compressor in the first embodiment shown in FIG. 1.
Figure 3:
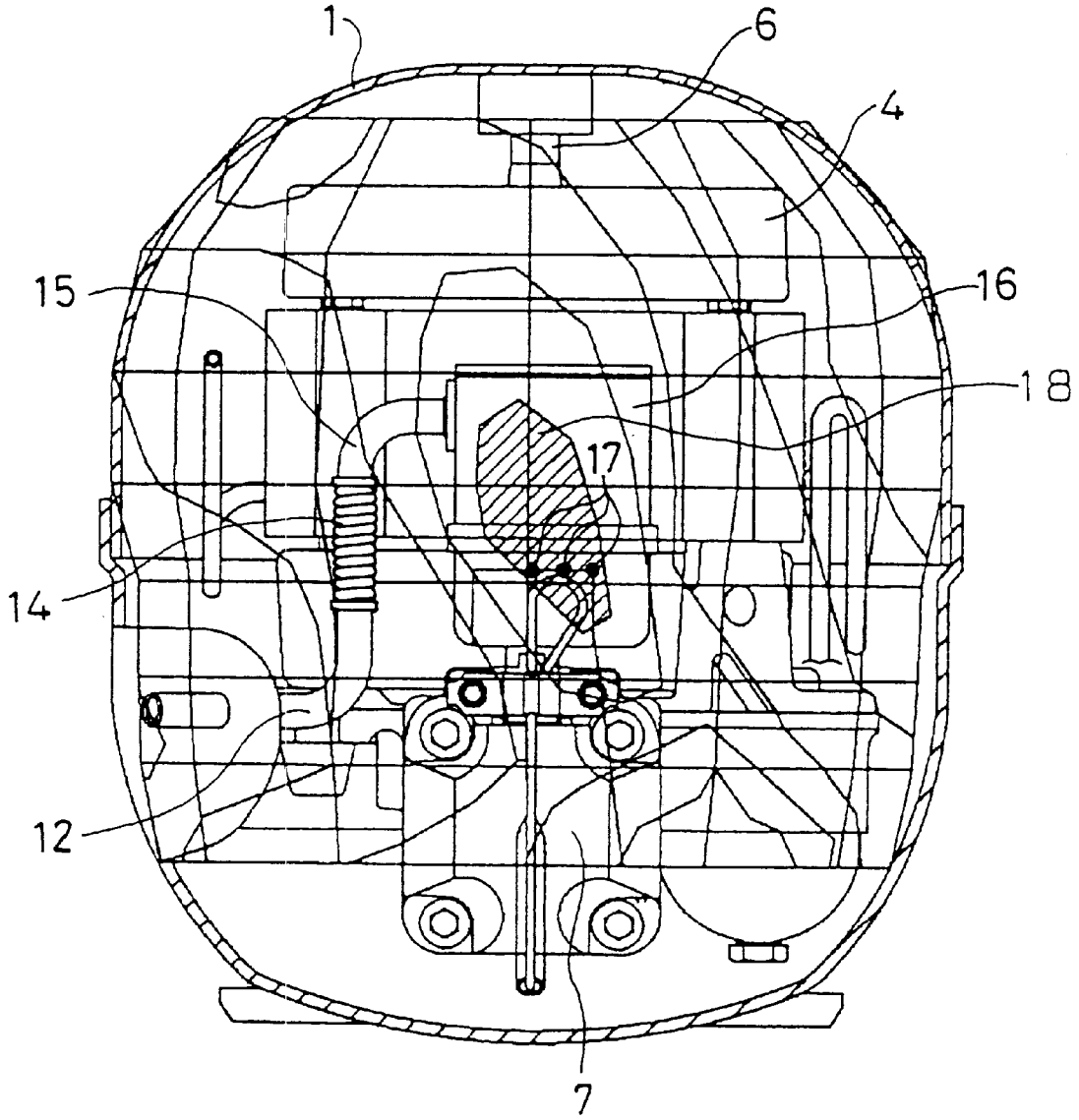
FIG. 3 illustrates positions of the nodes in a resonance frequency vibration mode for the main sound in a hermetic shell in the hermetic compressor in the first embodiment.

FIG. 1 is a front view of a structure of the hermetic compressor in the first embodiment of the present invention. In FIG. 1, a hermetic shell 1 shows its cross sectional view. FIG. 2 is a side cross sectional view of the hermetic compressor shown in FIG. 1. FIG. 3 illustrates positions of the nodes in the resonance frequency vibration mode for the main sound in the hermetic shell 1 provided in the hermetic compressor in the first embodiment.

As shown in FIGS. 1 and 2, inside the hermetic shell provided in the hermetic compressor in the first embodiment are housed an electric driving device 2 and a compressing mechanism 3. The electric driving device 2 includes a stator 4, a rotor 5, and a crank shaft 6. The compressing mechanism 3 includes a cylinder head 7, a cylinder 8, a piston 9, and a connecting rod 10. The connecting rod 10 is connected to an eccentric part 11 of the crank shaft 6 of the electric driving device 2 and used to change a rotary motion to a reciprocating motion. The electric driving device 2 and the compressing mechanism 3 are elastically supported by a spring 3*a* in the hermetic shell 1. The spring 3*a* absorbs vibrations of both the electric driving device 2 and the compressing mechanism 3, as well as shocks from external.

As shown in FIG. 1, a suction tube 12 is fixed to the hermetic shell 1 and disposed so as to upstand in the hermetic shell 1. A suction muffler 16 is formed with a low thermal conductivity material such as synthetic resin, for example, a material of 6.9 $(K \cdot cm^{-1})^{-1}$ or under in thermal conductivity, such as polybutylene terphthalate (PBT) resin of polyester resin. The muffler 16 is fixed to a cylinder head 7.

The suction tube 12 and the suction muffler 16 are connected to each other via a communicating portion 13. The communicating portion 13 includes a normally closed type coil spring 14 and a connecting tube 15. As shown in FIG. 1, the lower end of the coil spring 14 is press-fittingly fixed to the suction tube 12. The upper end of the coil spring 14 is press-fittingly fixed to one end of the connecting tube 15. The normally closed type coil spring 14 is provided to absorb vibrations such as shocks during transportation. When in an operation, the coil spring 14 is shaped like a cylindrical tube, thereby to prevent leaks of the refrigerant from the coil spring 14.

The other end of the connecting tube 15 is inserted in the suction muffler 16. The shell of the suction muffler 16 has one or more small holes (3 through-holes of 2.0 mm in diameter formed in the case of the first embodiment). The space inside the suction muffler 16 is communicating to the space inside the hermetic shell 1 through these small holes 17.

The striped portion shown in FIG. 3 indicates an area in which the nodes 18 are provided in a vibration mode for the resonance frequency in the hermetic shell 1. As shown in FIG. 3, the small holes 17 formed in the suction muffler 16 are positioned at the nodes 18 in a vibration mode for the resonance frequency in the hermetic shell 1. The vertical and horizontal lines other than the members of the hermetic compressor shown in FIG. 3 are coordinate axes used to calculate the positions of the nodes 18 in a vibration mode for the resonance frequency in the hermetic shell 1.

In the hermetic compressor in the first embodiment, composed as described above, a high density gas is guided into the cylinder 8 from the suction tube 12 according to the circulation of the refrigerant. If the refrigerant is in short supply due to a suction loss caused by resistance of the gas flow path in the suction route led into the cylinder 8, the refrigerant in the hermetic shell 1 is sucked and supplemented into the muffler 16 through the small holes 17. Since the refrigerant in the hermetic shell 1 is sucked and supplemented through the small holes 17 in such a way, the suction loss in the suction route can be minimized. In addition, the rippling sound to be generated in the suction process is attenuated by the suction muffler 16, so that the sound emitted from the small holes 17 into the suction muffler 16 is also attenuated. Furthermore, since the small holes 17 of the suction muffler 16 are formed at the positions of the nodes 18 in a vibration mode for the resonance frequency in the hermetic shell 1, the sound emitted from the small holes 17 into the hermetic shell 1 is attenuated to thereby suppress amplification of the resonance sound in the hermetic shell 1.

As described above, the suction muffler 16 of the hermetic compressor in the first embodiment is formed with a low thermal conductivity material such as synthetic resin. One or more small holes 17 are formed in the shell of the suction muffler 16 so as to be communicated to the space inside the hermetic shell 1. Furthermore, the small holes 17 in the first embodiment are formed at the positions of the nodes 18 in a vibration mode for the resonance frequency of the space in the hermetic shell 1. This is why the refrigerant in the hermetic shell 1 is sucked and supplemented through the small holes 17 when the refrigerant is in short supply due to a suction loss caused by the resistance of the gas flow path in the suction route in which a high density gas is led into the cylinder from the suction tube according to the circulation of the refrigerant. According to the first embodiment of the present invention, therefore, it is possible to obtain a compact enclosed type compressor in which the suction loss is minimized, the refrigerating capacity is improved, and noise generation is suppressed effectively as well.

Second Embodiment

Next, the hermetic compressor is in the second embodiment of the present invention will be described. The hermetic compressor in the second embodiment is composed just like the hermetic compressor in the first embodiment shown in FIGS. 1 and 2. The hermetic compressor in the second embodiment uses a refrigerant composed of a material that will not destroy the ozonosphere. FIGS. 1 and 2 will also be used to describe the hermetic compressor in the second embodiment.

The hermetic compressor in the second embodiment uses a refrigerant composed of HC (hydrocarbon) or HFC (hydro-fluorocarbon) that includes no chlorine. According to the circulation of such a refrigerant, a high density gas is guided into the cylinder 8 from the suction tube 12. If the refrigerant is in short supply due to a suction loss caused by the resistance of the gas flow path in the suction route, the refrigerant in the hermetic shell 1 is sucked and supplemented into the suction muffler 16 from the small holes 17. The hermetic compressor in the second embodiment can thus minimize the suction loss caused by the use of such a refrigerant as HC and HFC. Furthermore, since the hermetic compressor in the second embodiment is composed so that the rippling sound generated in the suction process is attenuated by the suction muffler 16 and the sound emitted from the small holes 17 into the suction muffler 16 is also attenuated by the suction muffler 16 at the same time.

Since the small holes 17 are positioned at the nodes 18 in a vibration mode for the resonance frequency of the space inside the hermetic shell 1 in the hermetic compressor in the first embodiment, the sound emitted from the small holes 17 into the hermetic shell 1 suppresses amplification of the resonance sound of the space inside the hermetic shell 1.

The hermetic compressor in the second embodiment 2 uses a refrigerant composed of HC or HFC. The resonance frequency of the space in the hermetic shell 1 filled with this refrigerant is related to the sound speed in the space filled with a refrigerant, so the resonance frequency differs among refrigerants. However, positions of the nodes 18 in a vibration mode for the resonance frequency is the same for any refrigerants.

The hermetic compressor in the second embodiment of the present invention uses a refrigerant composed of HC or HFC that includes no chlorine. The shell of the suction muffler 16 is provided with one or more small holes 17 positioned at the nodes 18 in a vibration mode for the resonance frequency of the space inside the hermetic shell. The small holes 17 are communicating to the space inside the hermetic shell 1.

In the hermetic compressor in the second embodiment, a shortage of the refrigerant is supplemented with the refrigerant gas sucked from the hermetic shell through the small holes when it occurs due to a suction loss caused by the resistance of the gas flow path in the suction route for leading a high density gas into the cylinder from the suction tube according to the circulation of the refrigerant. According to the second embodiment of the present invention, therefore, it is possible to obtain a hermetic compressor in which the suction loss is minimized, the refrigerating capacity is improved, and noise generation is suppressed effectively. Furthermore, since the hermetic compressor in the second embodiment of the present invention uses an HC or HFC refrigerant that includes no chlorine, it will not destroy the ozonosphere.

Third Embodiment

Next, the hermetic compressor in the third embodiment of the present invention will be described. The hermetic compressor in the third embodiment is composed just like the hermetic compressor in the first embodiment shown in FIGS. 1 and 2. The hermetic compressor in the third embodiment uses a refrigerant composed of a material that will not destroy the ozonosphere. FIGS. 1 and 2 will also be used to describe the hermetic compressor in the third embodiment.

The hermetic compressor in the third embodiment uses a mixed refrigerant composed of R-22 and R-152a, which are low in ODP (ozonosphere destroy parameter) respectively and a high density gas is guided into the cylinder 8 from the suction tube 12 according to the circulation of the refrigerant. A shortage of the refrigerant is supplemented with the refrigerant sucked from the hermetic shell 1 through the small holes 17 of the suction muffler 16 when it occurs due to a suction loss caused by the resistance of the gas flow path in the suction route. The hermetic compressor in the third embodiment can thus minimize the suction loss caused by the use of such a mixed refrigerant of R-22 and R-152a.

Furthermore, since the hermetic compressor in the third embodiment is composed so that the rippling sound generated in the suction process is attenuated by the suction muffler 16, the sound emitted from the small holes 17 into the suction muffler 16 is also attenuated by the suction muffler 16. Furthermore, since the small holes 17 are positioned at the nodes 18 in a vibration mode for the resonance frequency of the space inside the hermetic shell 1, the sound emitted from the small hole 17 into the hermetic shell 1 suppresses amplification of the resonance sound of the space inside the hermetic shell 1.

In the third embodiment in which a mixed refrigerant of R-22 and R-152a is used, the resonance frequency of the space in the hermetic shell 1 filled with this mixed refrigerant is related to the sound speed in the space filled with a refrigerant, so the resonance frequency is changed by the state of the refrigerant. However, positions of the nodes 18 in a vibration mode for the resonance frequency are the same for any refrigerants.

The hermetic compressor in the third embodiment of the present invention uses a mixed refrigerant composed of R-22 and R-152a. The shell of the suction muffler 16 is provided with one or more small holes 17 (3 through-holes of 2.0 mm in diameter formed in the case of the third embodiment)) positioned at the nodes 18 in a vibration mode for the resonance frequency of the space inside the hermetic shell. The small holes 17 are communicating to the space inside the hermetic shell 1. Since the refrigerant used in the hermetic compressor in the third embodiment is a mixed refrigerant composed of R-22 and R-152a that are low in ODP (ozone destroy parameter) respectively, the refrigerant will not destroy the ozonosphere. Furthermore, in the hermetic compressor in the third embodiment, a high density intake refrigerant gas is led into the cylinder from the suction tube according to the circulating refrigerant. And, a shortage of the refrigerant is supplemented with the gas sucked form the hermetic shell through the small holes when it occurs due to a suction loss caused by the resistance of the gas flow path in the suction route. According to the third embodiment of the present invention, therefore, it is possible to obtain a hermetic compressor in which the suction loss is minimized, the refrigerating capacity is improved, and noise generation is suppressed effectively.

Fourth Embodiment

Next, the hermetic compressor in the fourth embodiment of the present invention will be described. The hermetic compressor in the fourth embodiment is composed just like the hermetic compressor in the first embodiment shown in FIGS. 1 and 2. The hermetic compressor is driven with a fast rotation frequency. FIGS. 1 and 2 will also be used to describe the hermetic compressor in the fourth embodiment.

Since the hermetic compressor in the fourth embodiment is driven with a fast rotation frequency of 60 Hz or over, which is a household power supply frequency, the volumetric efficiency is degraded with a pressure loss significantly. In the hermetic compressor in the fourth embodiment of the present invention, however, a shortage of the refrigerant caused by a suction loss due to the resistance of the gas flow path is supplemented with the refrigerant gas sucked from the hermetic shell 1 into the suction muffler 16 through the small holes 17 formed therein. Since the hermetic compressor in the fourth embodiment takes such a configuration that the supplemental refrigerant is sucked through the small holes 17, the suction loss is minimized. Furthermore, since the rippling sound generated in the suction process is attenuated by the suction muffler 16, the sound emitted from the small holes 17 into the suction muffler 16 is also attenuated by the suction muffler 16. Furthermore, since the small holes 17 are positioned at the nodes 18 in a vibration mode for the resonance frequency of the space inside the hermetic shell 1, the sound emitted from the small holes 17 into the hermetic shell 1 suppresses amplification of the resonance sound in the space inside the hermetic shell 1.

Furthermore, the hermetic compressor in the fourth embodiment of the present invention is composed so as to be driven with a fast rotation supply frequency of 60 Hz or over using an inverter and the shell of the suction muffler 16 is provided with one or more small holes 17 (3 through-holes of 2.0 mm in diameter formed in this fourth embodiment) communicating to the space inside the hermetic shell, formed at the nodes 18 in a vibration mode for the resonance frequency of the space in the hermetic shell 1. Thus, much refrigerant gas is guided into the cylinder 8, so that the resistance of the gas flow path is increased in the suction route. To avoid this problem, a shortage of the refrigerant caused by a suction loss due to such the resistance of the gas flow path is supplemented with the refrigerant sucked from the hermetic shell 1 through the small holes 17. According to this fourth embodiment, therefore, it is possible to obtain a hermetic compressor in which the suction loss is minimized, the volumetric efficiency is improved, the refrigerating capacity is improved, and noise generation is suppressed significantly.

Fifth Embodiment

Figure 4:
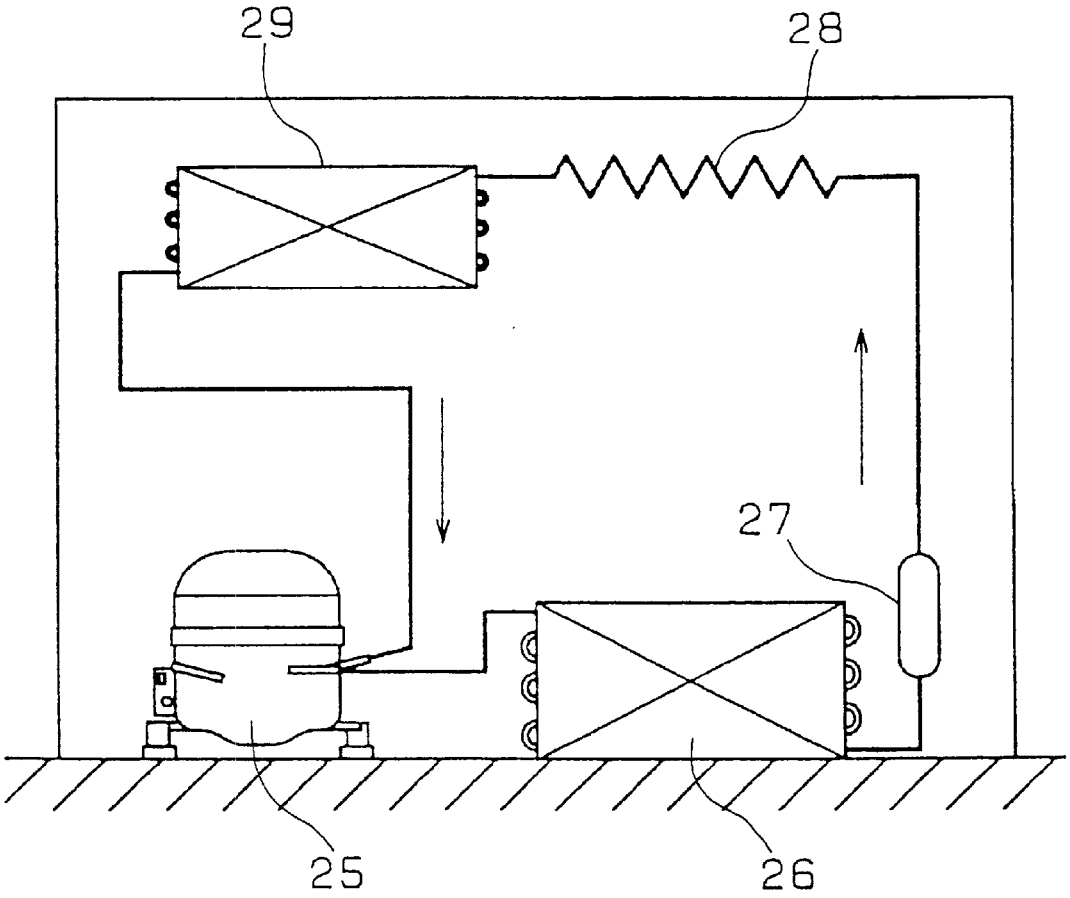
FIG. 4 is a schematic configuration of a cooling system in the first embodiment of the present invention.
Figure 5:
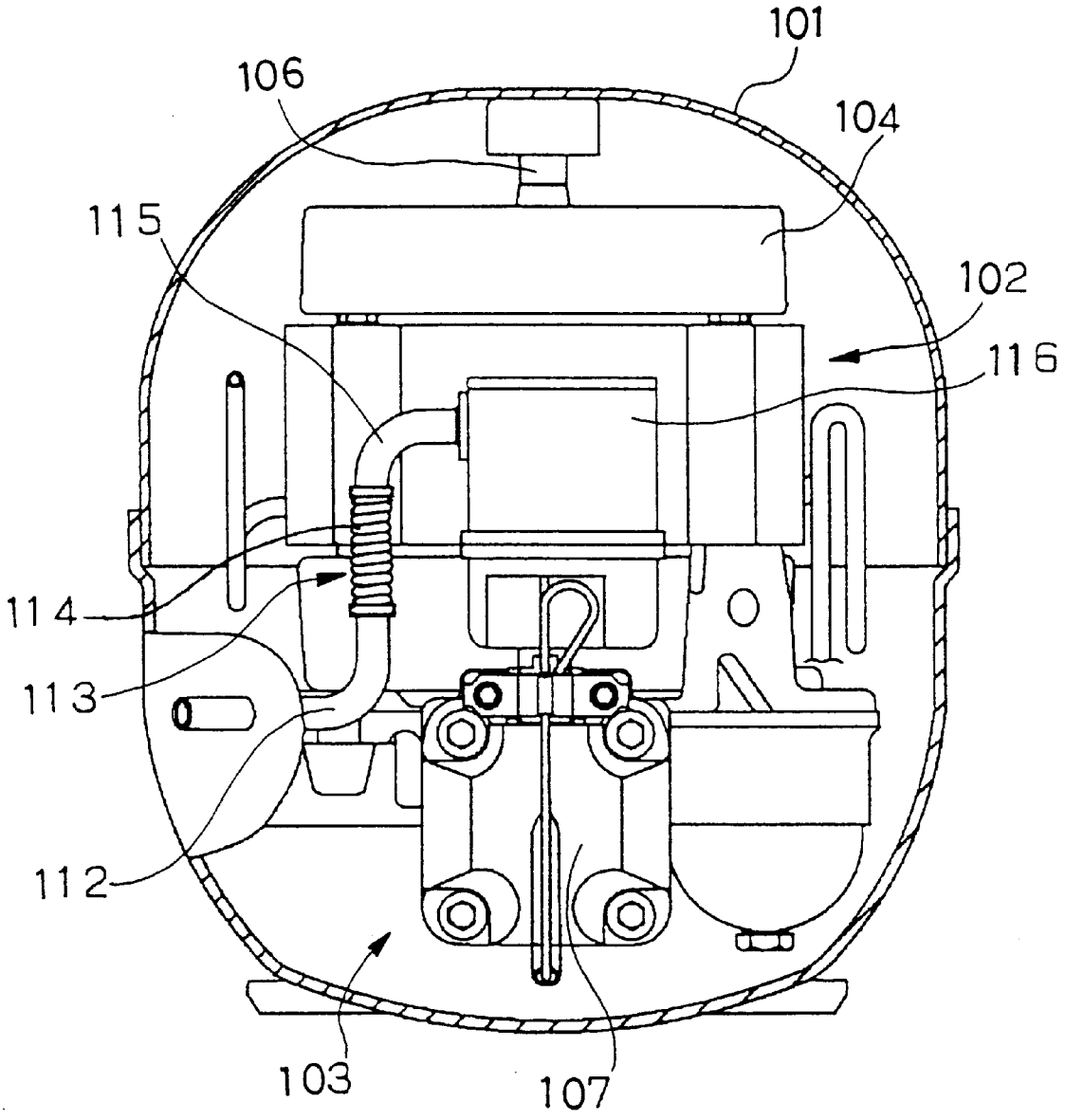
FIG. 5 is the front view of the conventional hermetic compressor.
Figure 6:
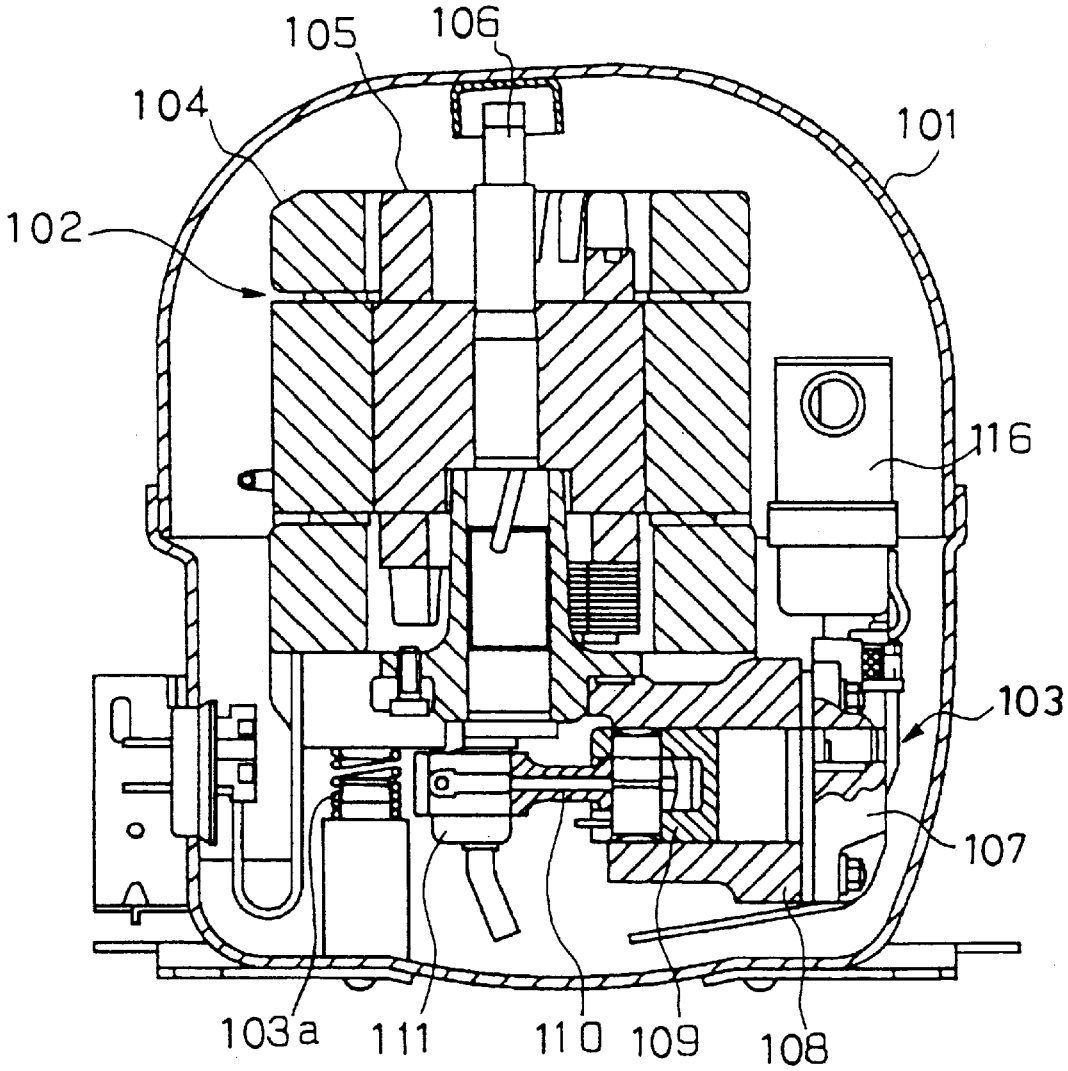
FIG. 6 is the side cross sectional view of the conventional hermetic compressor.

FIG. 4 is a schematic view of a cooling system in the fifth embodiment of the present invention. In the fifth embodiment, the hermetic compressor described in the first to fourth embodiments is used for the cooling system.

In FIG. 4, any of the enclosed embodiments described in the first to fourth embodiments may be used as a compressor 25. A refrigerant discharged from this compressor 25 is returned to the compressor after being circulated in a condenser 26, a drier 27, a capillary 28, and an evaporator 29.

In the cooling system in the fifth embodiment, composed as described above, the refrigerant compressed in the compressor 25 is condensed and liquefied in the condenser 26. Then, the liquefied refrigerant is fed to the capillary 28 via the drier 27 and decompressed in the capillary 28. The decompressed refrigerant is then evaporated in the evaporator 29. As a result, the evaporator 29 is cooled down. The refrigerant is sucked again into the compressor 25 so as to be compressed. The refrigerant is circulated in the cooling system as described above.

The compressor 25 may be any of the hermetic compressors described in the first to fourth embodiments. The capacity of the cooling system in the fifth embodiment depends on the refrigerating capacity of the compressor used for the cooling system. And, since the refrigerating capacity is improved and noise generation is suppressed in the compressor described in the above embodiments, the cooling system in the fifth embodiment can also realize high efficiency cooling and low noise.

The cooling system in the fifth embodiment of the present invention uses a hermetic compressor that sucks a high density refrigerant due to the circulation of the refrigerant such way to thereby realize high system efficiency and low noise.

Although the present invention has been describe din terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

INDUSTRIAL APPLICABILITY

The present invention is applied to a hermetic compressor and a cooling system for use with a refrigerator and a freezer, and particularly, to a hermetic compressor structured so that a refrigerant is led into a cylinder directly from a suction tube through a suction muffler.

What is claimed is:

1. A hermetic compressor comprising:

an electric driving device supported with elastic holding means in a hermetic shell and including a stator and a rotor;

a compressing mechanism driven by said electric driving device and used for compressing a refrigerant;

a suction tube passing through said hermetic shell;

a suction muffler formed with a low thermal conductivity material and fixed to said compressing mechanism;

communicating portions communicating said suction muffler to said suction tube; and means for communicating a space in a refrigerant suction path led to said compressing mechanism to a space in said hermetic shell, at node in a vibration mode for the resonance frequency in said hermetic shell.

2. A hermetic compressor in accordance with claim 1, wherein said means for communicating from said refrigerant suction path space led to said compressing mechanism to said space in said hermetic shell is one or more small holes, which are formed in the shell of said suction muffler to communicate the space in said hermetic shell to the space in said suction muffler.

3. A hermetic compressor in accordance with claim 1, wherein said refrigerant is HC (hydrocarbon) or HFC (hydro-fluorocarbon) including no chlorine.

4. A hermetic compressor in accordance with claim 2, wherein said refrigerant is HC (hydrocarbon) or HFC (hydro-fluorocarbon) including no chlorine.

5. A hermetic compressor in accordance with claim 1, wherein said refrigerant is a mixed refrigerant composed of R-22 and R-152a whose ODP (ozone destroy parameter) is low respectively.

6. A hermetic compressor in accordance with claim 2, wherein said refrigerant is a mixed refrigerant composed of R-22 and R-152a whose ODP (ozone destroy parameter) is low respectively.

7. A hermetic compressor in accordance with claim 1, wherein said electric driving device is operated by an inverter with a supply frequency of 60 Hz or over.

8. A cooling system comprising:

a compressor, a condenser, a drier, a capillary, and an evaporator, wherein said compressor includes an electric driving device supported with elastic holding means in a hermetic shell and having a stator and a rotor;

a compressing mechanism driven by said electric driving device and used for compressing a refrigerant;

a suction tube passing through said hermetic shell;

a suction muffler formed with a low conductivity material and fixed to said compressing mechanism;

communicating portions for communicating from said suction muffler to said suction tube; and means for communicating from a space in a refrigerant suction path led to said compressing mechanism to a space in said hermetic shell, at node in a vibration mode for the resonance frequency in said hermetic shell.

9. A cooling system in accordance with claim 8, wherein said means for communicating from the space in said refrigerant suction path led to said compressing mechanism to the space in said hermetic shell is one or more small holes, which are formed in the shell of said suction muffler to communicate the space in said hermetic shell to the space in said suction muffler.

10. A hermetic compressor in accordance with claim 2, wherein said electric driving device is operated by an inverter with a supply frequency of 60 Hz or over.

11. A cooling system in accordance with claim 8, wherein said refrigerant is HC (hydrocarbon) or HFC (hydro-fluorocarbon) including no chlorine.

12. A cooling system in accordance with claim 9, wherein said refrigerant is HC (hydrocarbon) or HFC (hydro-fluorocarbon) including no chlorine.

13. A cooling system in accordance with claim 8, wherein said refrigerant is a mixed refrigerant of R-22 and R-152a whose ODP (ozone destroy parameter) is low respectively.

14. A cooling system in accordance with claim 9, wherein said refrigerant is a mixed regrigerant of R-22 and R-152a whose ODP (ozone destroy parameter) is low respectively.

15. A cooling system in accordance with claim 8, wherein said electric driving device is operated by an inverter with a supply frequency of 60 Hz or over.

16. A cooling system in accordance with claim 9, wherein said electric driving device is operated by an inverter with a supply frequency of 60 Hz or over.

* * * * *